US005320656A

United States Patent [19]

Hammer

[11] Patent Number: 5,320,656

[45] Date of Patent: Jun. 14, 1994

[54] DEVICE FOR INTERCEPTING AND COLLECTING LIQUID MEDIA FROM ASCENDING GASEOUS CARRIERS

[75] Inventor: Frank Hammer, Freiburg-Tiengen, Fed. Rep. of Germany

[73] Assignee: GIF Gesellschaft für Ingenieurprojekte Freiburg mbH, Freiburg-Opfingen, Fed. Rep. of Germany

[21] Appl. No.: 967,096

[22] Filed: Oct. 27, 1992

[51] Int. Cl.[5] ..... B01D 45/06

[52] U.S. Cl. ..... 55/444; 55/462; 55/DIG. 36

[58] Field of Search ..... 55/440–446, 55/DIG. 36, DIG. 37, 462

[56] References Cited

U.S. PATENT DOCUMENTS

| | | | |
|---|---|---|---|
| 2,523,529 | 9/1950 | Zwickl | 55/442 X |
| 3,364,664 | 1/1968 | Doane | 55/442 X |
| 3,566,585 | 3/1971 | Voloshen et al. | 55/443 X |
| 3,813,856 | 6/1974 | Jensen | 55/446 X |
| 3,834,135 | 9/1974 | Jordan | 55/444 |
| 3,870,494 | 3/1975 | Doane | 55/443 |
| 3,890,124 | 6/1975 | Howes | 55/440 X |
| 3,910,782 | 10/1975 | Struble et al. | 55/444 |
| 4,099,941 | 7/1978 | Gutermuth et al. | 55/440 X |
| 4,101,299 | 7/1978 | Bertucci | 55/442 X |
| 4,189,990 | 2/1980 | Kittler | 55/444 X |
| 4,231,769 | 11/1980 | Ahlrich | 55/444 X |
| 4,354,863 | 10/1982 | Oleszak | 55/446 X |
| 4,877,430 | 10/1989 | Gutermuth | 55/446 X |
| 4,902,317 | 2/1990 | Gutermuth | 55/440 X |

FOREIGN PATENT DOCUMENTS

| | | | |
|---|---|---|---|
| 812559 | 9/1974 | Belgium . | |
| 0148289 | 7/1985 | European Pat. Off. . | |
| 0194527 | 8/1989 | European Pat. Off. . | |
| 22734 | 2/1962 | Fed. Rep. of Germany | 55/440 |
| 1452564 | 5/1969 | Fed. Rep. of Germany . | |
| 2718611 | 8/1990 | Fed. Rep. of Germany . | |
| 4001548 | 7/1991 | Fed. Rep. of Germany | 55/444 |
| WO91/17813 | 11/1991 | PCT Int'l Appl. | 55/444 |
| 2064616 | 6/1981 | United Kingdom . | |

*Primary Examiner*—Robert Spitzer
*Attorney, Agent, or Firm*—Darby & Darby

[57] ABSTRACT

A device for intercepting and collecting fats and/or moisture dispersed in an ascending gaseous carrier has a set of trough-shaped collecting elements which alternate with and whose marginal portions are overlapped by inverted trough-shaped intercepting elements. The lowermost sections of the collecting elements form part of shallow receptacles for collected fats and/or moisture, and such receptacles extend between end walls which are of one piece with the ends of main portions of the collecting elements. Such collecting elements can be produced by deep drawing suitably configurated blanks of sheet metal. The end walls and the marginal portions of the collecting elements have projections extending through slots in plate-like holders for the collecting elements.

21 Claims, 2 Drawing Sheets

DEVICE FOR INTERCEPTING AND COLLECTING LIQUID MEDIA FROM ASCENDING GASEOUS CARRIERS

BACKGROUND OF THE INVENTION

The invention relates to improvements in devices which can be utilized as drop ceilings in kitchens or similar establishments to intercept and collect liquid media (such as fat, grease and/or moisture) which are dispersed in gaseous carriers, e.g., in streams or flows of ascending air. More particularly, the invention relates to improvements in devices wherein trough-shaped collecting elements alternate with inverted trough-shaped intercepting elements for the liquid medium or media.

It is already known to assemble a set of spaced apart parallel elongated trough-shaped collecting elements with a set of inverted trough-shaped intercepting elements. The intercepting elements overlie but are spaced apart from the marginal portions of neighboring collecting elements to define therewith a plurality of paths for the flow of an ascending gaseous carrier. The liquid medium or media which are dispersed in the gaseous carrier impinge upon and are intercepted by the concave undersides of the intercepting elements and are caused to flow into and to gather along the concave upper sides of the neighboring collecting elements. The ends of the intercepting and/or collecting elements are attached to holders in the form of walls. Reference may be had, for example, to German Pat. No. 27 18 611 granted Aug. 8, 1990 to Helmut Kittler for "Separator for a room aerating and deaerating device". The intercepting and collecting elements of the patented separator resemble portions of elongated hollow cylinders each of which extends along an arc of more than 180 degrees.

European Pat. No. 0 194 527 granted Aug. 23, 1989 to Josef Hammer discloses a drop ceiling wherein the collecting elements are mounted on supports. Thus, when the collecting elements are to be cleaned to relieve them of collected liquid media (such as grease and/or fat), the supports must be cleaned at the same time. This involves additional maintenance work. The aforementioned separator of Kittler can be said to constitute a further development of the drop ceiling of Hammer in that the separator of Kittler is designed as a cassette which can be introduced into and relieved of intercepted and collected liquid media in a washing machine.

Devices of the type disclosed by Kittler and Hammer can be utilized, for example, in the kitchens of hotels and other large establishments wherein the temperature often rises to or even exceeds 40° C. If a device which is designed to intercept fats, grease and/or other liquid media, (e.g., moisture) is open to permit the gaseous carrier medium to pass therethrough, even very narrow passages for the flow of gaseous carrier suffice to permit the escape of a substantial percentage of liquid media. Such liquid media thereupon rise through the openings of the support for the drop ceiling and enter the flue or flues to be admitted into the atmosphere. Moreover, the escaping liquid media rapidly contaminate the component parts of the support for the drop ceiling as well as the rails or other holders for the support. This creates numerous problems because cleaning of the supports and of the holders therefor is a tedious and time-consuming task which cannot be carried out at frequent intervals.

Another drawback of presently known drop ceilings for use in large kitchens and/or similar establishments, wherein an ascending gaseous carrier is likely to entrain dispersed liquid media, is that the collecting elements are incapable of gathering relatively large quantities of liquids so that they must be relieved of collected liquids at frequent intervals. Attempts to increase the liquid-retaining capacity of such collecting elements include the provision of separately produced end walls which are welded to the end portions of the collecting elements. The welding of end walls to the collecting elements invariably entails an undesirable discoloration of the collecting elements and adversely affects the appearance of the entire drop ceiling. Moreover, the welding operation invariably entails at least some deformation of the collecting elements, and such deformation cannot be eliminated in a subsequent step except by resorting to highly expensive remedial techniques. It is to be borne in mind that the thickness of presently used collecting elements is normally less than 1 mm.

Attempts to eliminate the drawbacks of collecting elements with welded end walls include the resort to soldering (particularly brazing) techniques. This did not alleviate the problems because the utilization of hard solder necessitates operation at elevated temperatures. As a rule, the utilization of hard solder results in pronounced deformation of the collecting elements, namely a deformation which is so pronounced that it cannot be eliminated without unduly increasing the cost of the finished products. Attempts to use soft solder also failed to solve the aforediscussed problems which arise when using hard solder or when resorting to welding because the application of soft solder must be preceded by treatment with a highly corrosive substance which ensures that soft solder will adhere to the material of a collecting element. The corrosive action of such substances is sufficiently pronounced to affect the appearance and the integrity of collecting elements, even of those made of chrome-nickel steel or other high-quality and highly expensive materials. Corrosion of collecting elements which are used in drop ceilings of large kitchens and similar establishments is not acceptable to the owners and to the authorities.

OBJECTS OF THE INVENTION

An object of the invention is to provide a novel and improved device for interception and collection of liquid media which are dispersed in a gaseous carrier and to construct and assemble the device in such a way that it requires infrequent cleaning.

Another object of the invention is to provide a device which can be used as a drop ceiling or a grating for collection of fatty particles from a gaseous carrier and whose useful life is longer than that of devices with welded or soldered parts.

A further object of the invention is to provide a device which exhibits the advantages but does not embody the drawbacks of the aforedescribed and/or other conventional devices.

An additional object of the invention is to provide a device wherein the collecting elements can gather large quantities of intercepted liquid media.

Still another object of the invention is to provide novel and improved collecting elements for use in a device of the above outlined character.

A further object of the invention is to provide a novel and improved method of making collecting elements for use in the above outlined device for interception and collection of liquid media which are entrained by a gaseous carrier.

Another object of the invention is to provide collecting elements which need not embody any soldered, welded or like parts.

An additional object of the invention is to provide a novel and improved combination of collecting elements and holder or holders therefor for use in the above outlined device.

Still another object of the invention is to provide a method of making collecting devices in such a way that a finished collecting device is automatically equipped with means for securing it to one or more holders or other supports.

A further object of the invention is to provide a device which embodies collecting elements and one or more holders of the above outlined character and can be readily cleaned in available machines.

Another object of the invention is to provide a device which can be utilized as a superior substitute for existing drop ceilings in large kitchens and like establishments.

SUMMARY OF THE INVENTION

The invention is embodied in a device which can be used as a drop ceiling and serves to separate and intercept a liquid medium (e.g., grease, fat and/or moisture) which is dispersed or otherwise distributed in a flowing gaseous carrier, particularly in an ascending current or stream of atmospheric air. The improved device comprises a plurality of spaced apart substantially parallel trough-shaped elongated collecting elements each having a first end, a second end, two elongated marginal portions between the first and second ends and a main portion between the marginal portions. Each end of each collecting element includes an end wall which is of one piece with and extends transversely of the respective main portion to define with the latter a receptacle for collected liquid medium. The improved device further comprises a plurality of elongated inverted trough-shaped intercepting elements which alternate with and spacedly overlie the marginal portions of neighboring collecting elements so that the collecting elements and the intercepting elements jointly define a plurality of paths or passages for the flow of gaseous carrier whereby the intercepting elements intercept and the receptacles of the collecting elements collect the liquid medium which is distributed in the gaseous carrier. Still further, the improved device comprises a holder which is adjacent and supports the first ends of the collecting elements.

The main portions of the collecting elements include lowermost sections having edge faces at the first and second ends of the respective collecting elements, and the end walls are or can be of one piece with the respective edge faces of the corresponding lowermost sections.

The end walls of each collecting element can constitute deep drawn extensions of an originally flat or substantially flat blank (e.g., a sheet metal blank) which has been converted into the respective collecting element. The main portion of each collecting element is preferably provided with a substantially concave upper side between the respective marginal portions and the respective first and second ends.

The end walls at the first ends of the collecting elements preferably include projections extending away from the respective main portions and into sockets ( e.g., in the form of slots) provided therefor in the holder. The projections can include or constitute bent-over portions of the respective end walls and are preferably remote from the lowermost sections of the respective main portions.

Each marginal portion of each collecting element can also include a projection which extends beyond the first end of the respective collecting element and into a socket (e.g., in the form of a slot) in the holder. The projections of the marginal portions are disposed at a level above the respective collecting receptacles. The projections of the end walls have lengths (as seen in the longitudinal direction of the respective collecting elements) which preferably match or approximate the lengths of projections of the marginal portions. The holder has a first side which confronts the first ends of the collecting elements and a second side facing away from the collecting elements; the projections of the end walls and of the marginal portions of the collecting elements are preferably bendable against the second side of the holder.

Each end wall can have a height (as measured from the lowermost section of the respective main portion) in the range of between approximately 3 and 8–10 mm, preferably in the range of 5–6 mm. The radius of curvature of the concave upper side of each main portion is preferably greater than the height of the respective end walls. Each end wall can have a substantially horizontal top side; such top side can constitute the upper side or surface of the respective projection which forms part of an end wall. The top sides of the end walls can constitute secants of circles having radii corresponding to the radii of curvature of concave upper sides of main portions of the collecting elements.

The collecting elements can include substantially rounded parts constituting transitions between the main portions and the end walls at the ends of the collecting elements. Alternatively or in addition to such configurations, the collecting elements can comprise portions which constitute rounded transitions between their end walls and the projections of such end walls.

The end walls are or can be at least substantially flat.

When the improved device is in actual use and the gaseous carrier is an ascending stream or flow of air or another suitable gas, the collecting elements are preferably disposed at a first level and at least the uppermost portions of the inverted trough-shaped intercepting elements extend to a second level above the first level.

The novel features which are considered as characteristic of the invention are set forth in particular in the appended claims. The improved device itself, however, both as to its construction and the mode of making, installing and using the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 5:
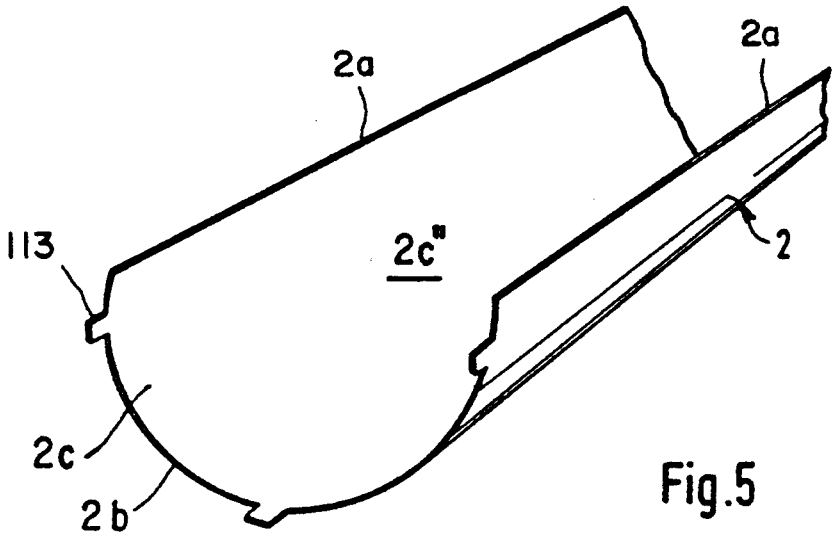
FIG. 5 is a fragmentary perspective view of an intercepting element which can be used in a device utilizing collecting elements of the type shown in FIGS. 1, 2 and 4, the intercepting element being shown in inverted condition.
Figure 6:
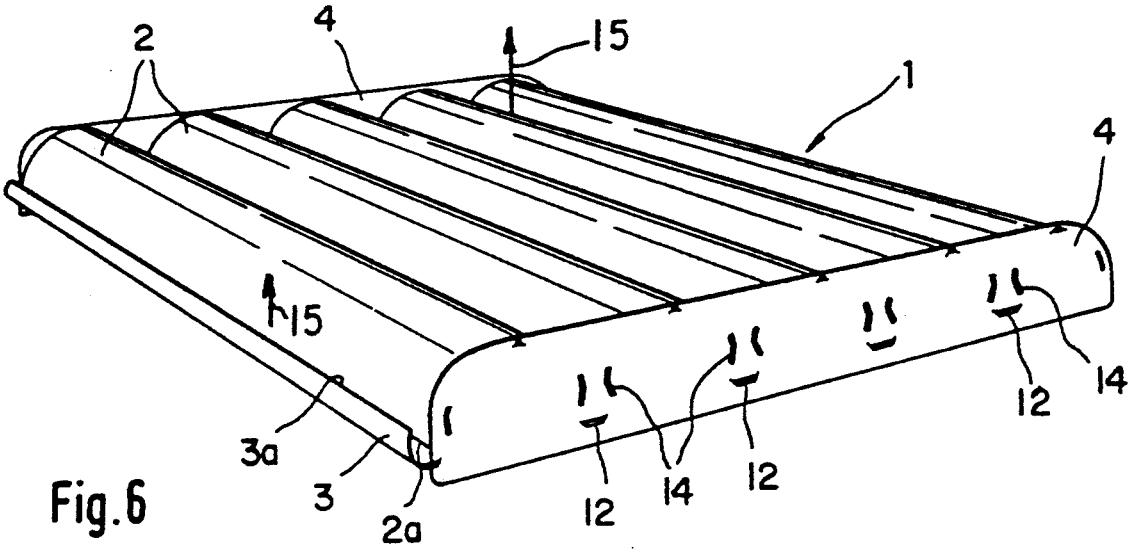
FIG. 6 is a perspective view of a device which employs collecting elements of the type shown in FIGS. 1, 2 and 4, intercepting elements of the type shown in FIG. 5, and two elongated plate-like holders which are connected with the respective ends of the collecting elements.

Referring first to FIG. 6, there is shown a device 1 which can constitute a means for intercepting and collecting liquid media dispersed and/or otherwise distributed in a gaseous carrier and which is constructed and assembled in accordance with a presently preferred embodiment of the invention. The device 1 can constitute a drop ceiling or a grease or fat gathering grating in a large kitchen and constitutes a relatively thin body having a total of six elongated spaced apart parallel trough-shaped collecting elements 3 of sheet metal or the like, a total of five elongated parallel inverted trough-shaped intercepting elements 2, and two spaced apart parallel holders 4 which carry at least the respective ends of the collecting elements 3. One marginal portion 2*a* (see FIG. 5) of each intercepting element 2 is disposed between two marginal portions 3*a* of one neighboring collecting element 3, and the other marginal portion 2*a* of each intercepting element 2 is located between the two marginal portions 3*a* of the other adjacent collecting element 3. This ensures that any liquid media which are intercepted by the concave undersides 2*c*" of the main portions 2*c* of intercepting elements 2 can trickle down beyond the two marginal portions 2*a* of the respective element 2 and onto the concave upper sides 3*c*" (FIGS. 1, 2 and 4) of main portions 3*c* of the adjacent collecting elements 3. The marginal portions 2*a* and 3*a* of neighboring elements 2 and 3 define a plurality of passages or paths (note the arrows 15 in FIG. 6) for the flow of ascending gaseous carrier (such as hot air) which can escape through the device 1 to thereupon enter a flue, not shown, for evacuation from the kitchen. The neighboring marginal portions 2*a*, 3*a* can define chambers of the type shown at 7 in FIG. 1 of German Pat. No. 27 18 611 to Kittler. Such chambers serve for separation of intercepted liquid media from the ascending gaseous carrier whereby the separated liquid media trickle along the concave upper sides 3*c*" of main portions 3*c* of the elements 3 and toward and into the lowermost sections 3*c*' of the respective main portions 3*c*. The intercepted and collected liquid media can form pools which extend all the way between the two holders 4. Each of these holders can constitute an elongated panel which is disposed in a substantially vertical plane and can carry the respective ends 3*b* of the collecting elements 3 as well as the respective ends 2*b* of the intercepting elements 2.

The aforementioned chambers between the marginal portions 2*a*, 3*a* of neighboring elements 2, 3 further serve to decelerate the ascending gaseous carriers and to cause at least some agitation or turbulence with attendant more pronounced separation of liquid medium or media from the gaseous carrier.

Figure 1:
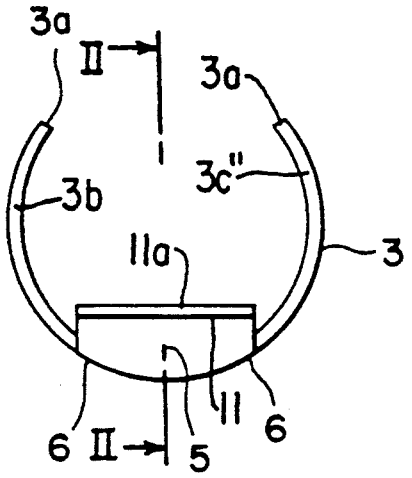
FIG. 1 is an end elevational view of a collecting element which is constructed and shaped in accordance with a presently preferred embodiment of the invention.
Figure 2:
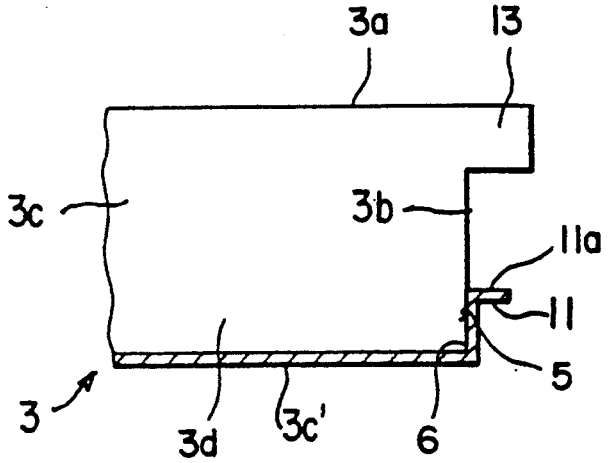
FIG. 2 is a central longitudinal sectional view of the collecting element substantially as seen in the direction of arrows from the line II—II in FIG. 1.
Figure 3:
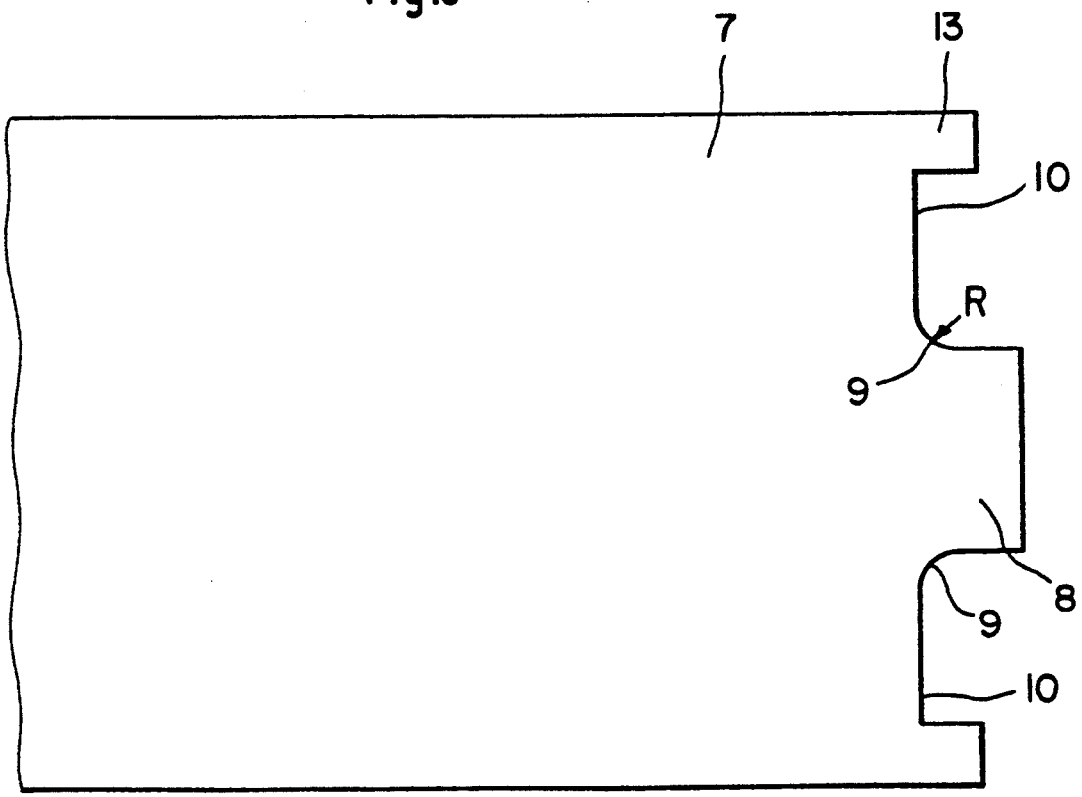
FIG. 3 is a fragmentary plan view of a blank which can be converted into a collecting element of the type shown in FIGS. 1 and 2.
Figure 4:
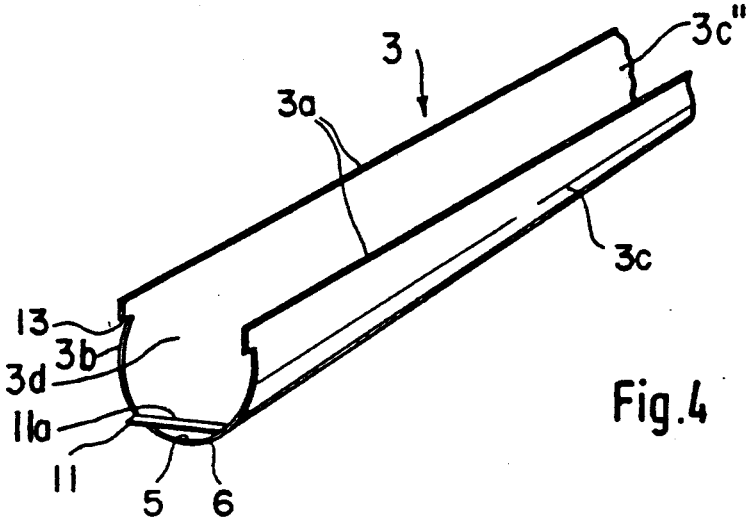
FIG. 4 is a smaller-scale fragmentary perspective view of a collecting element of the type shown in FIGS. 1 and 2.

In accordance with a presently preferred embodiment of the invention, each collecting element 3 is made from an elongated sheet metal blank 7 (FIG. 3) which is deformed in an available shaping machine, e.g., by deep drawing, to be converted into an element 3 of the type shown in FIGS. 1, 2 and 4. When the device 1 is in actual use, the concave upper sides 3*c*" of main portions 3*c* of the collecting elements 3 face upwardly, and each such concave upper side 3*c*" extends between the two elongated marginal portions 3*a* and the two spaced apart ends 3*b* of the respective element 3. In order to permit accumulation of reasonably large quantities (e.g., pools) of liquid media at the lowermost sections 3*c*' of the main portions 3*c*, the two ends 3*b* of each collecting element 3 are provided with end walls 5 which are of one piece with the adjacent edge faces 6 of the main portion 3*c*. Each end wall 5 can have a height of between 3 and 8–10 mm, preferably between 5–6 mm, and the radius of curvature of the concave upper side 3*c*" of each main portion 3*c* preferably exceeds the height of the respective end walls 5. The deep drawing operation which is preferably resorted to for the making of the end walls 5 ensures that the receptacle 3*d* which extends between the two end walls 5 above the lowermost or deepmost portion 3*c*' of the respective main portion 3*c* can reliably retain a reasonably large quantity of collected liquid medium which remains therein until the entire device 1 is detached from its support or supports (not shown) for introduction into a washing machine which can simultaneously clean the intercepting elements 2 as well as the holders 4.

The end walls 5 and their projections 11 constitute converted extensions or tongues 8 of the respective blanks 7. FIG. 3 merely shows one of the extensions 8, but one such extension is provided at each end of each blank to ensure that each receptacle 3*d* will extend between two spaced apart end walls 5 when the conversion of the blank 7 into a collecting element 3 is completed. FIG. 3 further shows that the illustrated extension 8 is bounded by two transversely extending edge faces 10 of the blank 7 and that the blank includes curved portions 9 with relatively large radii of curvature R between the lateral edge faces of the extension 8 and the edge faces 10. Each edge face 10 extends between the respective extension 8 and two projections or lugs 13 which form part of the respective marginal portions 3*a* when the conversion of the blank 7 into a collecting element 3 is completed.

As can be seen in FIG. 1, each collecting element 3 can constitute a portion of a hollow cylindrical body which extends along an arc of more than 180°, e.g., close to 270°. The top face 11*a* of each projection 11 can be said to constitute a secant of a circle having a radius which matches or approximates the radius of curvature of the concave upper side 3*c*" of the main portion 3*c* of a finished collecting element 3.

The feature that the edge faces 10 merge into the lateral faces of the respective extension 8 with curved portions 9 having relatively large radii of curvature R renders it possible to subject the blank 7 to treatment in a deep drawing machine to form the end walls 5 which are of one piece along the arcuate edge faces 6 of considerable length so as to form receptacles 3*d* of reasonable depth, i.e., receptacles 3*d* which can gather relatively large quantities of intercepted and collected liquids. The end walls 5 are preferably flat so that they can lie flush against those sides or surfaces of the respective holders 4 which confront the sets of intercepting elements 2 and collecting elements 3. The projections 11 then extend through the complementary sockets (e.g., slots) 12 in the respective holders 4 (see FIG. 6), and the projections 13 of the marginal portions 3*a* extend through complementary sockets (e.g., slots) 14 of the respective holders 4. Those parts of the projections 11 and 13 which extend beyond the outer sides of the holders 4 (namely beyond those sides which face away from the collecting elements 3 and intercepting elements 2) can be bent against such outer sides to thus ensure reliable retention of the elements 3 in optimum positions relative to the holders 4 and the intercepting elements 2. The manner in which the intercepting elements 2 are secured to the holders 4 forms no part of the invention; for example, the end faces of the elements 2 can be secured to the adjacent sides of the holders 4 by resorting to a suitable adhesive or in a manner to be described with reference to FIG. 5. The length of the projections 11 can equal or approximate the length of the projections 13, as seen in the longitudinal direction of the respective collecting elements 3. The outer side of each end wall 5 is preferably flush with the edge faces 10 at the corresponding end 3*b* of a finished collecting element 3; this ensures that the outer sides of the end walls 5 as well as the edge faces 10 can abut the inner sides of the respective holders 4 when the assembly of the device 1 is completed.

Instead of bending over the projections 11 and 13 at the outer sides of the respective holders 4, it is equally within the purview of the invention to provide such projections with slots or holes for pins or keys which retain the collecting elements 3 in requisite positions relative to the holders 4.

FIGS. 4, 5 and 6 show that the radii of curvature of the concave sides 2*c*″ of the intercepting elements 2 can appreciably exceed the radii of curvature of the concave sides 3*c*″ of the collecting elements 3. FIG. 5 further shows that the ends 2*b* of the intercepting elements 2 can be provided with projections 113 analogous to the projections 13 and serving to facilitate connection of the ends 2*b* to the respective holders 4. All that is necessary is to provide each holder 4 with sockets 12 for the projections 11, with sockets 14 for the projections 13 and with sockets (not shown) for the projections 113.

It is presently preferred to provide the collecting elements 3 with rounded portions which constitute transitions between the main portions 3*c* and the corresponding end walls 5 and/or with rounded portions constituting transitions between the end walls 5 and the respective platform-like projections 11.

An important advantage of the improved device 1 is that each of its elements 3 can collect a relatively large quantity of liquid media (e.g., fat and/or grease) and that the collecting quantity cannot escape from the respective receptacle 3*d* because the ends of each such receptacle are reliably sealed by the respective end walls 5. The top sides or faces 11*a* of the projections 11 are preferably horizontal when the device 1 is properly installed in a kitchen or in another establishment wherein ascending currents of air or another gaseous carrier are likely to entrain appreciable quantities of one or more liquid media which should be intercepted before they enter the atmosphere outside of the establishment. Furthermore, the entire device 1 can be produced and assembled at a reasonable cost and can be cleaned in existing washing or like machines.

Another important advantage of the improved device 1, and particularly of its collecting elements 3, is that the collected liquid media are reliably confined in the receptacles 3*d* even though the end walls 5 need not be welded or soldered to the respective main portions 3*c*. This ensures that the making of the end walls does not adversely affect the appearance of the finished collecting elements and/or that the material of such collecting elements is not corroded or otherwise adversely affected as a result of the making of end walls 5.

The shaping of end walls 5 without the need for any heating, or for any pronounced heating which could affect the appearance and/or the quality of the collecting elements 3, ensures that the connections between the end walls 5 and the main portions 3*c* of the respective elements 3 are devoid of cracks and/or other passages for escape of the collected liquid medium or media so that the collecting action of the improved elements 3 is highly reliable and the elements 3 must be cleaned only when their receptacles 3*d* are at least substantially filled with collected liquids.

It is also possible to form the end walls 5 by simply upsetting the respective extensions 8 of a blank 7. The deep drawing treatment is preferred at this time because this contributes to the appearance of the finished collecting element and each of the thus formed end walls 5 is or can be flat to ensure the establishment of more reliable and more eye-pleasing connections with the holders 4. The method of making the collecting elements 3 can be such that the respective blanks 7 are deep drawn at least in the regions of their ends, i.e., to form the end walls 5.

The projections 11 or the projections 13 can be omitted. However, the provision of projections 11 and 13 (with the projections 13 located at a level above the projections 11 when the elements 3 are assembled with the holders 4) is preferred at this time because this ensures that the connections between the elements 3 and the holders 4 are reliable and long-lasting.

The exact height of the end walls 5 will depend on a number of factors, such as the intended use of the device 1, the quantity of the intercepted liquid media to be collected in the receptacles 3*d* and/or the safety factor (to prevent any overflowing of collected liquid media from the receptacles 3*d*). Furthermore, relatively low end walls 5 will be preferred if the manufacturer of collecting elements 3 desires to simplify the deep drawing operation. Still further, the height of the end walls 5 will depend or may depend on the extent to which the marginal portions 2*a* of the intercepting elements 2 should project into the interior of the adjacent collecting elements 3. As a rule, the marginal portions 2*a* of the elements 2 will be at least slightly spaced apart from (i.e., located at a level above) the top faces 11*a* of projections 11 of the end walls 5 when the elements 2 and 3 are assembled in a manner as shown in FIG. 6. The aforedescribed mounting of the collecting elements 3 in such a way that the top faces 11*a* of their projections 11 are located in horizontal planes also contributes to greater capacity of the receptacles 3*d* without unduly increasing the height of the end walls 5.

The provision of rounded transitions between the main portions 3*c* and the end walls 5 (at the edge faces 6) and/or between the end walls 5 and their projections 11 reduces the likelihood of unpredictable and undesirable deformation of the blanks 7 during conversion into collecting elements 3.

The making of collecting elements 3 (i.e., conversion of the blanks 7) can be completed in the machine which is used to carry out the deep drawing operation. This contributes to lower cost and renders it possible to mass produce the collecting elements 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A device for separating and intercepting a liquid medium which is distributed in a flowing gaseous carrier, comprising a plurality of spaced apart substantially parallel trough-shaped elongated collecting elements each having a first end, a second end, two elongated marginal portions between the first and second ends and a main portion between the marginal portions, each of said ends including an end wall of one piece with and extending transversely of the main portion to define with the main portion a receptacle for collected liquid medium; a plurality of elongated inverted trough-shaped intercepting elements alternating with and spacedly overlying the marginal portions of neighboring collecting elements, said collecting elements and said intercepting elements defining a plurality of paths for the flow of gaseous carrier whereby the intercepting elements intercept and the receptacles of the collecting elements collect the liquid medium which is distributed in the gaseous carrier; and a holder adjacent and supporting the first ends of said collecting elements, the end walls at the first ends of said collecting elements including projections extending away from the main portions and into sockets provided therefor in said holder.

2. The device of claim 1, wherein said main portions each include lowermost sections having edge faces at the first and second ends, said end walls being of one piece with the edge faces.

3. The device of claim 2, wherein the end walls of each of said collecting elements are deep drawn extensions of an originally flat blank.

4. The device of claim 3, wherein the main portion of each of said collecting elements has a substantially concave upper side between the marginal portions and the first and second ends.

5. The device of claim 2, wherein said end walls have edge faces and a curved portion extending between one of said edge faces of said lowermost portions and one of said edge faces of said end walls.

6. The device of claim 1, wherein said projections include bent-over portions of the end walls and are remote from the lowermost sections of the main portions.

7. The device of claim 1, wherein each of said marginal portions includes a projection extending into a socket of said holder.

8. The device of claim 7, wherein said projections are disposed at a level above the receptacles.

9. The device of claim 7, wherein the end walls at the first ends of said collecting elements have second projections extending away from the main portions and through second sockets provided in said holder.

10. The device of claim 9, wherein said second projections have substantially identical lengths in the longitudinal direction of the collecting elements.

11. The device of claim 1, wherein each of said main portions include a lowermost section and each of said end walls has a height of between approximately 3 and 10 mm as measured upwardly from the lowermost section.

12. The device of claim 11, wherein each of said main portions has a concave upper side with a radius of curvature greater than the height of the end walls.

13. The device of claim 11, wherein said height is between 5 and 6 mm.

14. The device of claim 1, wherein each of said end walls has a substantially horizontal top side.

15. The device of claim 14, wherein each of said main portions has a concave upper side and said top sides constitute secants of circles having radii at least approximating the radii of curvature of the concave upper sides.

16. The device of claim 1, wherein said collecting elements include substantially rounded transitions between the main portions and the end walls of the ends thereof.

17. The device of claim 1, wherein said collecting elements include projections extending from the end walls in directions away from the main portions, said collecting elements having rounded transitions between said end walls and the projections.

18. The device of claim 1, wherein said end walls are flat.

19. The device of claim 1, wherein said collecting elements are disposed at a first level and said intercepting elements have portions extending to a second level above said first level.

20. The device of claim 1, wherein said receptacle is seamless.

21. A device for separating and intercepting a liquid medium which is distributed in a flowing gaseous carrier, comprising a plurality of spaced apart substantially parallel trough-shaped elongated collecting elements each having a first end, a second end, two elongated marginal portions between the first and second ends and a main portion between the marginal portions, each of said ends including an end wall of one piece with and extending transversely of the main portion to define with the main portion a receptacle for collected liquid medium; a plurality of elongated inverted trough-shaped intercepting elements alternating with and spacedly overlying the marginal portions of neighboring collecting elements, said collecting elements and said intercepting elements defining a plurality of paths for the flow of gaseous carrier whereby the intercepting elements intercept and the receptacles of the collecting elements collect the liquid medium which is distributed in the gaseous carrier; and a holder adjacent and supporting the first ends of said collecting elements, said holder having a first side confronting the first ends of said collecting elements and a second side facing away from said collecting elements, said projections being bendable against the second side of said holder.

* * * * *